US005136960A

United States Patent [19]

Patout

[11] Patent Number: 5,136,960

[45] Date of Patent: Aug. 11, 1992

[54] METHOD AND APPARATUS FOR REDUCING THE DRAFT AND INCREASING THE LOAD BEARING AREA AND STABILITY OF MARINE DRILLING BARGES

[76] Inventor: Philip J. Patout, 221 Ramblewood Dr., Lafayette, La. 70508

[21] Appl. No.: 564,405

[22] Filed: Aug. 8, 1990

[51] Int. Cl.[5] ..... E02B 17/00

[52] U.S. Cl. ..... 114/260; 114/123; 114/164

[58] Field of Search ..... 405/203-209; 114/264, 265, 123, 258-260, 61, 125

[56] References Cited

U.S. PATENT DOCUMENTS

| | | | |
|---|---|---|---|
| 2,921,442 | 1/1960 | Laborde et al. | 114/265 X |
| 2,995,900 | 8/1961 | Hunsucker | 405/203 |
| 3,025,678 | 3/1962 | Dawson | 61/46.5 |
| 3,099,912 | 8/1963 | Wolff | 114/123 X |
| 4,084,529 | 4/1978 | Katernberg | 114/45 |
| 4,118,942 | 10/1978 | Liautaud | 405/205 X |
| 4,495,880 | 1/1985 | Maniscalco et al. | 114/123 |
| 4,497,594 | 2/1985 | Fern | 405/204 X |
| 4,622,912 | 11/1986 | Bleke | 114/123 |
| 4,714,382 | 12/1987 | Khachaturian | 405/204 |
| 4,744,697 | 5/1988 | Coppens | 405/204 |

*Primary Examiner*—Edwin L. Swinehart
*Attorney, Agent, or Firm*—William W. Stagg

[57] ABSTRACT

An apparatus for reducing the draft and increasing the load bearing area and stability of a Marine drilling barge may be temporarily or permanently mounted to the barge. The apparatus includes twin parallel hulls separated by and connected to a tension resistant truss, a support frame mounted to the twin parallel hulls, compression resistant members connected to the support frame that span between the parallel hulls, and pumps to remove water ballast from the hulls so that the apparatus can be raised and lowered in the water. The apparatus is submerged, the barge to be modified is then situated between the submerged apparatus hulls, the ballast is then removed from the submerged hulls to emerge the apparatus and lift the barge. When connected to the barge the apparatus provides a reduction in barge draft. The apparatus and barge may then be moved in combination and submerged together as a single unit. When submerged the apparatus provides additional bottom load bearing surface area and stability.

12 Claims, 7 Drawing Sheets

METHOD AND APPARATUS FOR REDUCING THE DRAFT AND INCREASING THE LOAD BEARING AREA AND STABILITY OF MARINE DRILLING BARGES

FIELD OF INVENTION

The present invention relates generally to the field of marine drilling vessels and more particularly, is concerned with apparatus and method for reducing the draft and increasing the load bearing area and stability of existing marine drilling vessels known in the industry as bay barges and posted barges.

BACKGROUND OF THE INVENTION

The search for oil and gas and other minerals has through the years been carried out in shallow inland and offshore waters. Significant deposits of oil and gas are located in those areas. This is particularly true of the immediate offshore and inland waters of the United States Gulf Coast surrounding South Louisiana and East Texas. Marine access to well locations in waters as little as 3 feet in depth is often necessary.

It has been standard practice in the industry to drill and service wells located in these shallow water areas by mounting drilling and workover rigs on barges. Specialized barges have been developed for these purposes. In shallow inland protected waters a submergible barge known as a bay barge is utilized. In deeper waters a similar submergible barge equipped with a deck elevated on columns called a posted barge is often used. The typical barge hull is substantially flat on the bottom and is rectangular in cross-section and has a length varying from 150 to 220 feet, a width varying from 40 to 60 feet and a hull depth of 12 to 14 feet.

The drilling rig and drilling equipment is located on the barge deck. The barge deck also supports an elevated structure for the drilling mast. The hull of the drilling barge is typically notched or keyed out at one end. The drilling rig and mast are located over the keyed area of the barge hull which straddles the desired well location.

Because most of the equipment weight is located in the area of the keyed hull, the barge trim is uneven in that it draws more water on the keyed end than on the end without the key.

The existing drilling barges typically draw from 5 to 8 feet of water when loaded. These rigs are floated and towed to the drilling location. They are then submerged by flooding the barge hull with water until it rests on the water bottom. The flat hull bottom serves as the foundation, supporting the vessel and distributing the barge loads to the supporting water bottom. The water depths in which these drilling vessels can be effectively used varies. Bay barges are more effectively utilized in depths from 5 to 13 feet where the deck can be above the waterline when the barge hull is submerged. Posted barges with elevated decks are used in deeper waters up to 20 feet or more in depth.

It is current practice to utilize these barges in very shallow water locations. These shallow water locations are in areas where the water depth is less than that drawn by the barge. To move the barge the water bottoms are dredged to a depth sufficient to accommodate the barge.

The dredging is time consuming and increases the cost of barge location. The dredging may cause significant harm to the delicate coastal environment. Recent environmental concerns have made dredging permits more difficult to obtain. This has restricted access to areas formally accessible by the conventional barges described above.

In areas where the water depths are adequate to float a barge onto location dredging may still present a functional as well as an environmental concern. The barges once on location are submerged so that the barge rests on the water bottom supporting the drill deck and drilling equipment above the water level. The bearing capacity of the soil on the water bottom must be sufficient to maintain the barge at a fixed lateral and vertical position while the barge and rig is being subjected to wind, wave and tidal action during the drilling operation. This often requires the exiting bottom to be dredged out to a depth sufficient to expose soil of adequate bearing capacity. Shell or other fill material is then used to replace the dredged out area and the barge is pulled over the dredged out area and submerged into the proper location. Then, the barge is often held in place with piling known as spuds.

Replacing the dredged soil with shell is an addition to the cost of the drilling rig location. The shell or soft bottom is often washed away by the wave and tidal action. This can result in the barge and rig being moved off the well location. The barge must be relocated, further increasing the expense of the drilling operation. When using a posted barge in exposed deeper waters subjected to wind and sea conditions of the Gulf of Mexico the barge is unstable and tends to move laterally off of its intended location. Typically, clusters of wood pilings are driven along the outer perimeter of the barge to which the barge is connected to provide stability. Three to five clusters of piling per side may be used. Typically, the wind and wave action often will break or dislodge these piling clusters. This results in the rig moving off location. Posted barges seldom make use of retractable steel piling known as spuds to improve barge stability. When the spuds are mounted externally on the outsides of the barge hull, the width of the barge unit would be increased causing the barge to be too wide to pass through narrow canals and locks. Equipping barges with internally located spuds has been shied away from because the steel spuds commonly bend under load while in use and a spud extended below the barge that is bent or deformed could not be pulled up through the spudwells or ports and the barge could be moved only after great difficulty.

A large number of the posted and bay barges described above have been built. The environmental and functional concerns described renders these existing barges obsolete and unusable in certain coastal areas. Thus, there exists a need to provide a relatively inexpensive way to modify these existing barges so as to effectively eliminate the dredging requirements and improve the stability and bearing area disadvantages now associated with these barges.

SUMMARY OF INVENTION

The present invention provides a method and apparatus to adapt and modify existing barges already in use to satisfy the aforementioned needs. The invention embodies a unique design that allows for a simple and cost effective modification of existing drilling vessels. It provides for the attachment of twin flat bottomed hulls to existing drilling barges. The additional hulls thereby increase the buoyancy of the barge. Further, the additional hulls increase the load bearing surface area and stability of the barge as a drilling platform when the barge and apparatus is submerged to the water bottom as a unit. Further, the additional hulls when accompanied by the use of retractable piling or spuds additionally increases the stability of the barge.

Furthermore, the apparatus can be either temporarily or permanently attached to the existing barges. Temporary attachment would modify the barge to provide the beneficial features of the apparatus while allowing removing of the apparatus from the barge when the additional features are not needed.

Accordingly, the present invention relates to apparatus and method for reducing the draft and increasing the load bearing area and stability of existing drilling vessels by temporarily or permanently attaching additional flat bottomed hulls to the vessels. The apparatus may be equipped with retractable steel piling known as spuds or removable shear skirts to provide additional stability to the apparatus and barge in combination.

The invention includes the steps of providing an apparatus with twin flat bottomed outrigger hulls connected at their base, submerging the outrigger hulls of the apparatus by adding ballast, floating the existing drilling barge between the outrigger hulls, removing the ballast to the outrigger hulls to reduce the draft of the drilling barge, connecting the outrigger hulls to the existing drilling barge, moving the barge and apparatus in combination to the desired location, adding ballast to the apparatus hulls and barge so as to allow the apparatus and barge to sink and come to rest on the water bottom and thereby increase the load bearing area of the existing barge and add stability to the barge while on location.

It is a further object of this invention to provide an apparatus to be temporarily or permanently attached to the hull of existing drilling barges to facilitate their use in shallow waters without dredging.

It is a further object of this invention to provide a simplified method and apparatus to increase the stability of the barge and load bearing area of the barge to reduce the soil bearing pressure on the water bottoms when the barge is submerged.

It is a further object of this invention to provide to the barge with retractable piling or spuds while the combined barge and apparatus is on location to secure the barge in position and increase its stability.

These and other objects of the invention will be more apparent from the detailed description of the preferred embodiments which follows.

DESCRIPTION OF THE PREFERRED EMBODIMENT(S)

Figure 1:
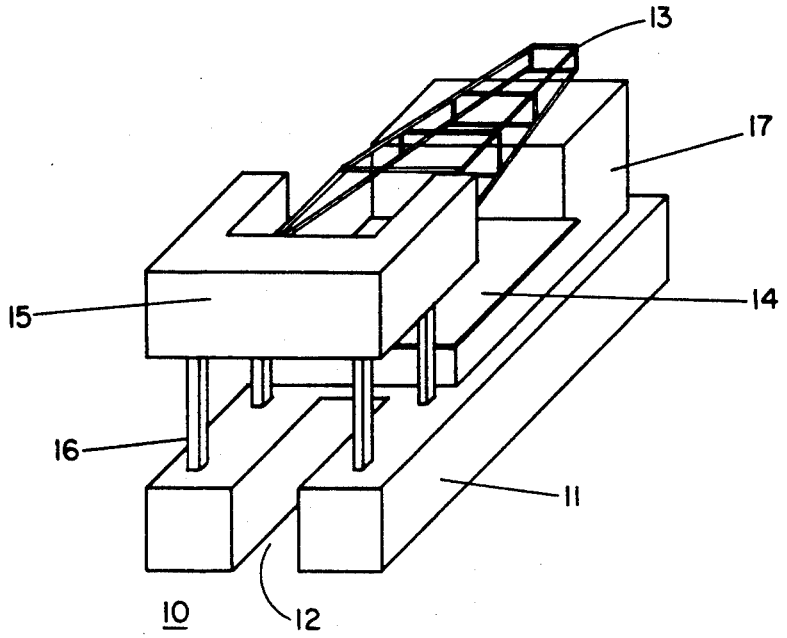
FIG. 1 is a perspective view of a typical conventional drilling barge.

Referring now to the drawings, and more particularly to FIG. 1, there is shown a perspective view of the typical drilling barge 10. The typical barge currently in use has a flat bottom rectangular hull 11. Incorporated in the hull 11 is a slotted keyway 12 over which the drilling mast 13 is located. Other typical features of the barge include the pipe rack 14, the engine shed 15, the substructure 16 and the living quarters 17.

Figure 2:
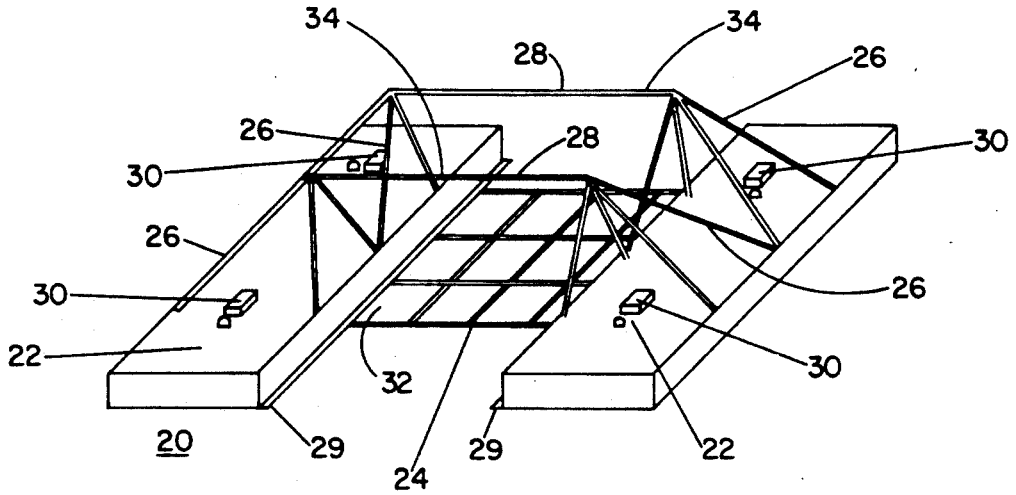
FIG. 2 is a perspective view of a preferred embodiment of the invention.

FIG. 2 shows a perspective view of the apparatus, generally designated 20, for reducing the draft and increasing the load bearing area and stability of the typical drilling barge 10. The apparatus 20 basically includes parallel rigid hulls 22, a means 24 generally for connecting said hulls together and transferring tension loads between the hulls 22 that are generated by buoyant and other forces when the apparatus is in use, support frames 26 mounted on the deck of the hulls 22, and means 28 generally for transferring compression loads generated by buoyant and other forces when the apparatus us in use, means 29 for transferring shear loads between the barge 10 and the apparatus 20 generated by buoyant and other forces when the apparatus is in use, and a means 30 generally for adding and removing ballast from the hulls 22 in order to alternatively raise and float the apparatus 20.

Figure 3:
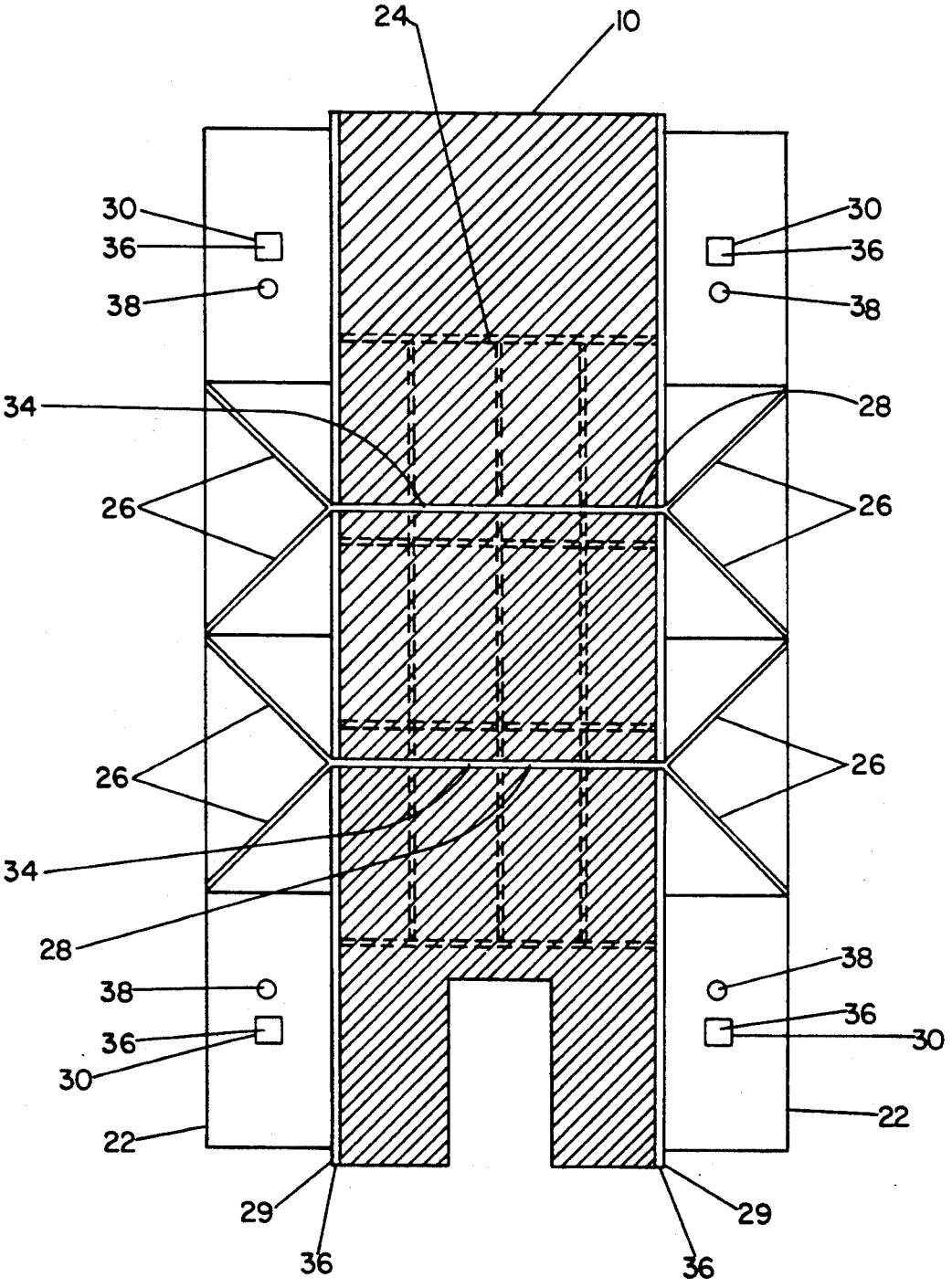
FIG. 3 is a plan view of a preferred embodiment of the invention and a conventional drilling barge in combination.
Figure 4:
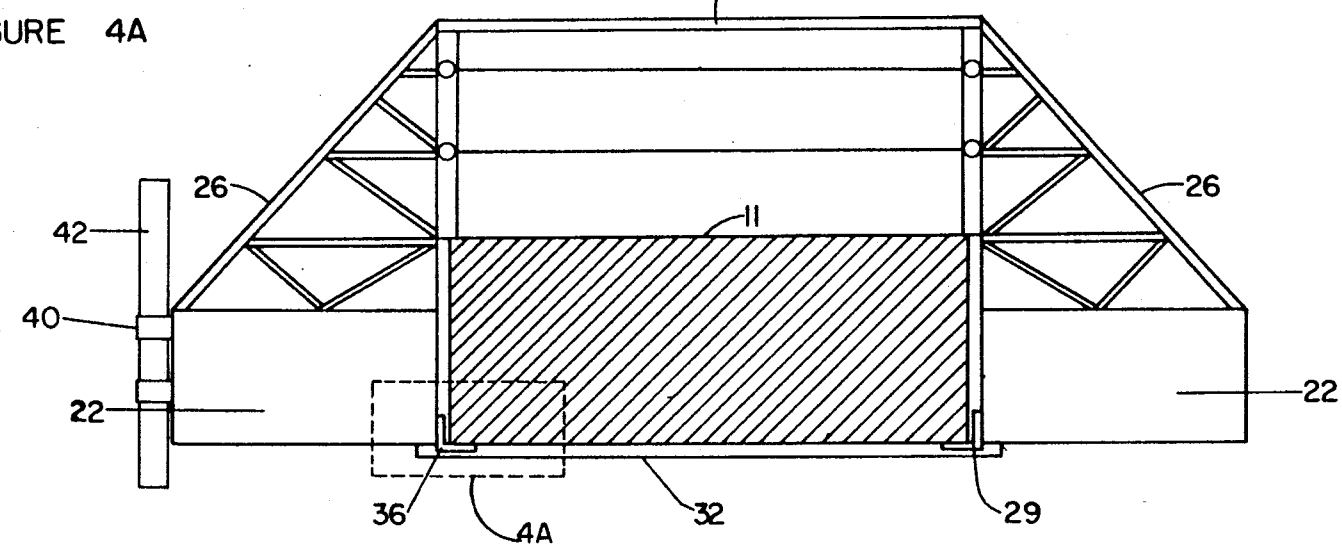
FIG. 4 is a front elevation view of FIG. 3.

In the preferred embodiment of the apparatus 20 shown in FIGS. 2, 3 and 4, the hulls 22 are substantially rectangular in cross-section and have a flat bottom. The apparatus 20 is configurated so that the bottom of hull 11 of the barge 10 and the bottom of the hulls 22 of the apparatus 20 are located in substantially the same plane when they are joined so as to provide a uniform bearing area to distribute barge loads to the water bottom soil. The length of the hulls 22 may vary but should roughly correspond to the length of the drilling barge 10 on which the apparatus 20 is to be used. The means 24 for connecting the hulls 2 together and transferring the tension loads preferably includes a truss or frame 32 comprised of tubular structural pipe located between and at the base of the hulls 22. Other means 24 for transferring tension loads such as a network of structural plate or structural grating could also be utilized.

The support frames 26 are also comprised of structural tubing although a frame comprised of structural members of any shape would suffice. The means 28 generally for transferring compression loads include horizontal tubular compression members 34 mounted between the support frames 26. The compression loads could be sustained by a number of techniques such as a truss or by utilizing existing features of the barge 10 such as the pipe rack 14. The principal problem associated with the means 28 generally for transferring the compression loads is the potential for conflicts of the transferring means 28 with the structural features of barge 10 such as the pipe rack 14 and the substructure 16. Single horizontal compression members 34 are preferably utilized to minimize those conflicts.

The means 29 generally for transferring shear loads between the barge 10 and the twin hulls 22 includes a shelf 36 comprised of L-shaped structural plating welded to the barge side of the hulls 22. The bottom of barge 10 rests on the protruding shelf 36 and can be temporarily welded into place. The means 29 generally for transferring shear and the means 24 generally for transferring tension may also be incorporated into a single member having the ability to do both functions. That could be accomplished by having the truss 32 fastened at its hull 22 connecting points in such a manner so as to adequately transfer both shear and tension loads without deviating from the spirit of the invention. Other means for transferring shear loads are readily apparent. The means 30 generally for adding and removing ballast includes a pump 36 and access port 38 whereby water can be added or removed to sink or float the hulls.

Figure 5:
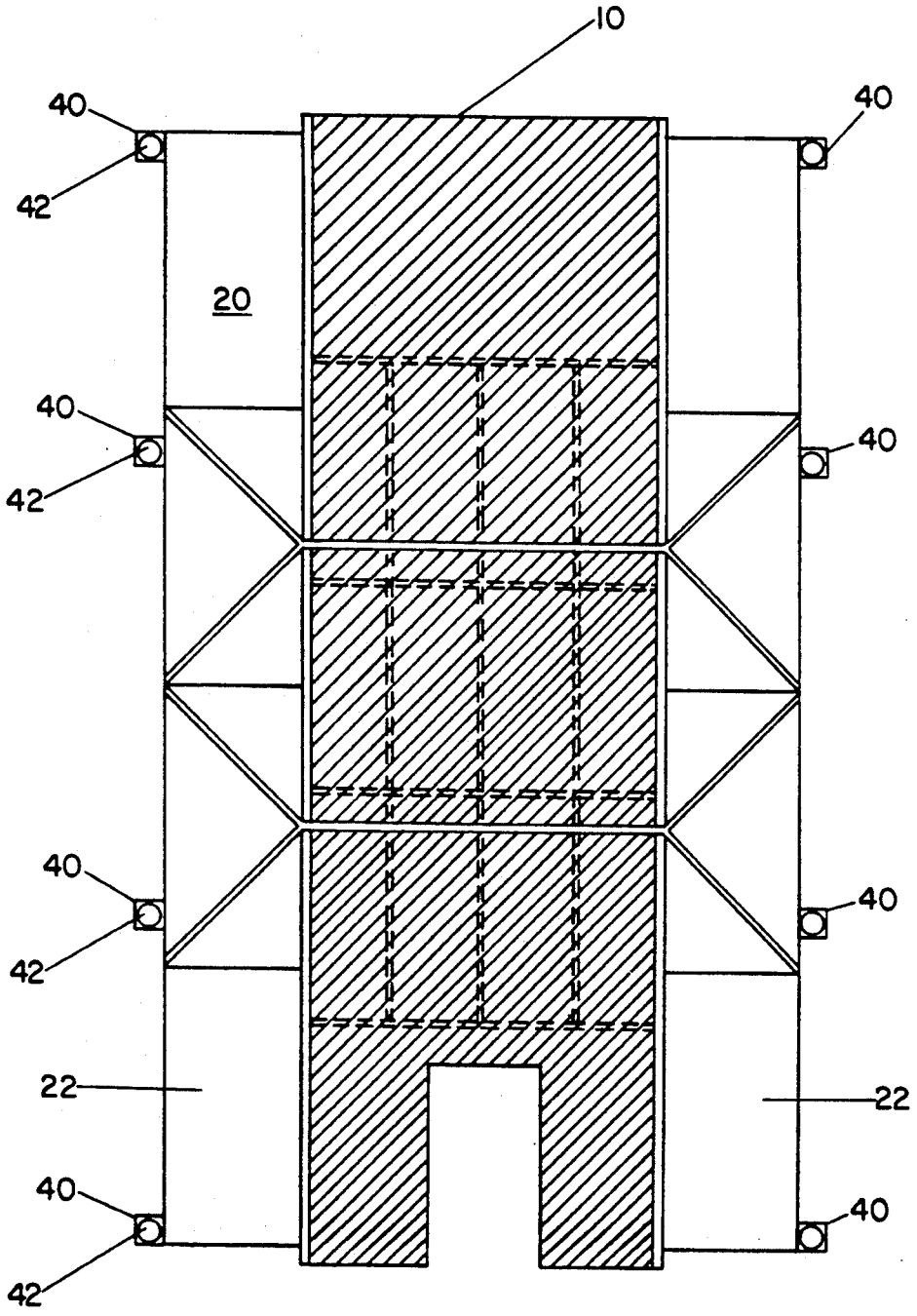
FIG. 5 is a plan view of the invention and drilling barge in combination equipped with guides for spuds.

FIG. 4 shows a cross-sectional view of the apparatus 20 and the barge 10 in combination. The hull 11 outline of barge 10 is shown with diagonal lines. The other features of the barge 10 are omitted for clarity. The bottom of hull 11 of the barge 10 and the bottom of each hull 22 of the apparatus 20 are in substantially the same horizontal plane. The truss 32 is shown below the hulls 22 and 11 and will be compressed into the soil when the apparatus 20 and barge 10 are submerged to the water bottom. For illustration purposes the guides 40 and the spuds 42 as shown in plan in FIG. 5 are shown to the left in elevation in FIG. 4.

Figure 4A:
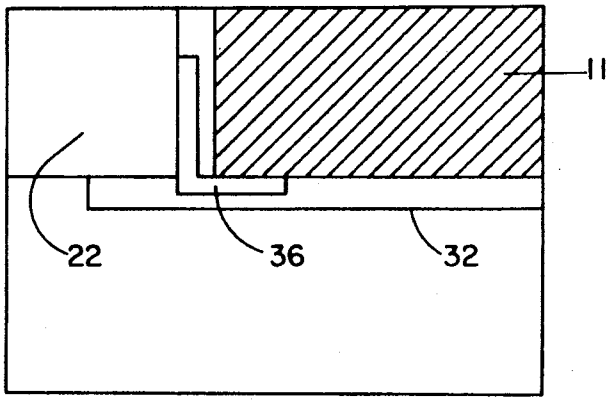
FIG. 4A is a detail of the shear shelf.

FIG. 4A shows an enlargement of the area where the hull 11 of barge 10 is supported by the shelf 36 which is connected to the hull 22 of the apparatus 20. The bottoms of barge hull 11 and the apparatus hull 22 are essentially in the same plane in this preferred embodiment. A tubular member of the truss 32 for transferring tension loads is also shown.

The apparatus 20 is utilized by adding ballast, generally by pumping water, to the hulls 22 of the apparatus so as to sink the apparatus to a depth sufficient to float the barge 10 over the parallel hull 22 connecting means 24. The barge 10 then can be moved into a position between the parallel hulls 22 of the apparatus 20. The exact position of the hulls 22 in relation to the barge 10 may vary. Ideally the barge 10 would be positioned between the parallel hulls 22 in a manner so as to level the trim of the barge 10 when the ballast is removed. The ballast is removed generally by pumping out the added ballast water from the hulls 22.

After the barge 10 is positioned between the hulls 22 in the desired location, the compression members 34 are placed and the ballast is then removed from the hulls 22. Removal of the ballast floats both the hulls 22 and correspondingly the barge 10 thereby reducing the barge draft. The amount of barge draft reduction can be varied and depends upon the size of the hulls 22 and the amount of ballast removed from the hulls 22. The barge 10 can then be temporarily or permanently attached to the hulls 22 of the apparatus 20 by welding or other fastening means. This will allow the barge 10 and apparatus 20 to be moved as a unit to the well location under the reduced draft condition.

When the combined barge 10 and apparatus 20 reach the well location the ballast is added to the barge 10 and the apparatus 20 by pumping water into the hull 11 of barge 10 and into the hulls 22, generally of the apparatus 20, or other means. This allows the combined barge 10 and apparatus 20 to settle to the water bottom to provide a stable drilling foundation.

In situations requiring additional drilling barge stability on the water bottom, such as when a posted barge is used in unprotected waters, guides 40 for retractable anchor piling known as spuds 42 may be attached externally to the hulls 22 along the hull periphery as shown in plan view in FIG. 5 and in elevation in FIG. 4. The spuds 42 are forced down into the water bottom soil by winching or other means to provide additional stability to the apparatus 20 and barge 10 in combination. The additional width provided by the combined barge 10 and apparatus 20 in combination provides increased spacing or distance between the spuds when compared to spuds that could be used on the drilling barge alone without the apparatus and correspondingly increases the spud efficiency in providing stability to the drilling rig. This increased spacing and outside external peripheral location provides more efficient spuds than those that could be incorporated directly into or on the drill barge 10 without use of the apparatus 20. These guides 40 and spuds 42 may only be necessary when wind, tide, soil and other conditions warrant the use of additional load bearing means to resist the lateral loads applied to the barge by external environmental factors.

Figure 6:
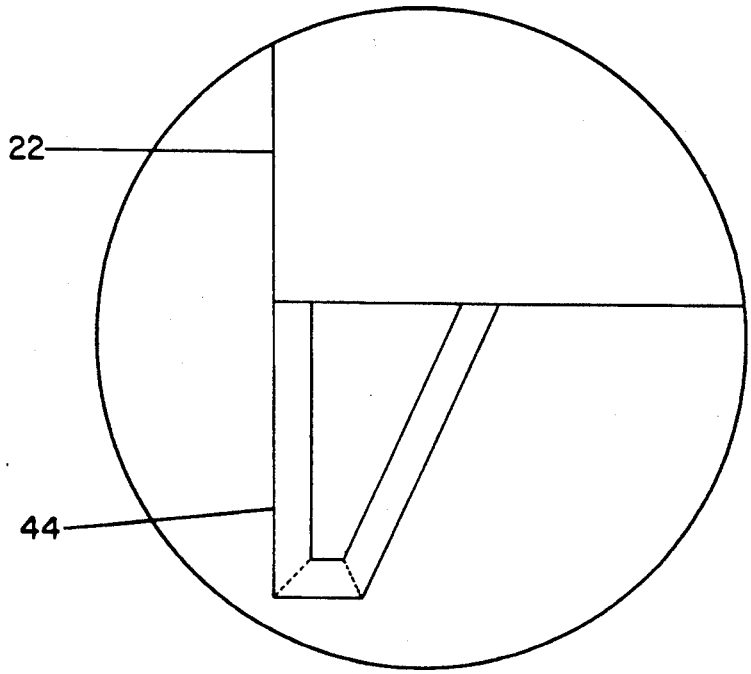
FIG. 6 is a detail of the alternative shear skirt at the edge of the apparatus hull.

FIG. 6 shows an alternative cross-section view of the hull 22 having a removable rib 44 projecting perpendicularly from the hull bottom. For additional assistance in resisting lateral wind, wave and tide loads to the combined barge 10 and apparatus 20 a removable rib 44 projecting from the bottom of each hull 22 may be utilized. This is feasible only when the apparatus 20 is utilized as a means to increase barge load bearing area and stability and not as a means to reduce barge draft. The rib 44 is ideally made of structural steel plate and welded to the bottom of each hull 22 along the outside edges. The ribs 44 are embedded into the soil of the water bottom by the bearing loads of the barge 10.

Figure 7:
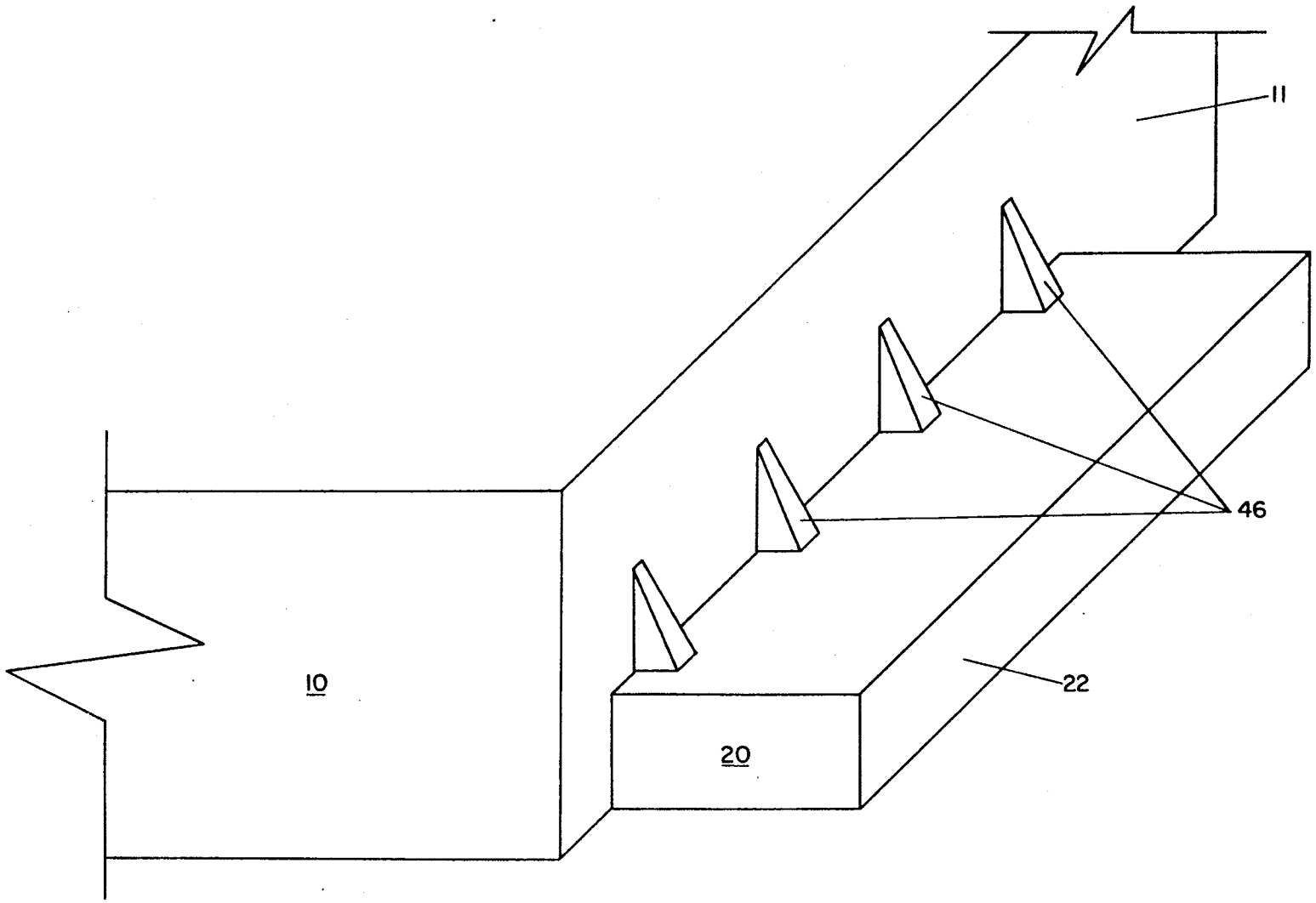
FIG. 7 is a partial perspective view of the invention and conventional drilling barge in combination showing an alternative method of transferring shear loads between the barge and invention.

FIG. 7, a partial perspective view of the barge 10 and apparatus 20 in combination, shows an alternative means 29 for transferring the shear loads between the barge hull 11 and the parallel apparatus hulls 22. Other details of the apparatus 20 and barge 1 have been omitted for clarity. A series of brackets 46 are connected to the barge hull 11 by welding or other means at a distance from the bottom of barge hull 11 approximately the same as the depth of apparatus hull 22. In this manner the bottom of barge hull 11 and apparatus hulls 22 are held substantially in the same plane.

The apparatus 20 can be temporarily or permanently attached to the typical barge 10 by welding or other means. The temporary attachment is preferable since one apparatus 20 can be fabricated and then utilized only on those barges in need of the increase in buoyancy or load bearing area and stability or both. When not needed on a particular barge 10 the apparatus 20 can be removed and leased or loaned out for use on another barge. The apparatus 20 is therefore portable in the sense that it is removable and reusable on drilling barges having the typical design described herein.

Figure 8:
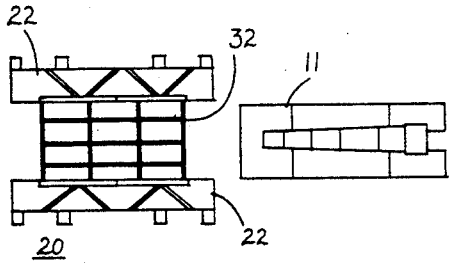
FIG. 8 is a plan view of the apparatus and drilling barge prior to installation of the apparatus.
Figure 9:
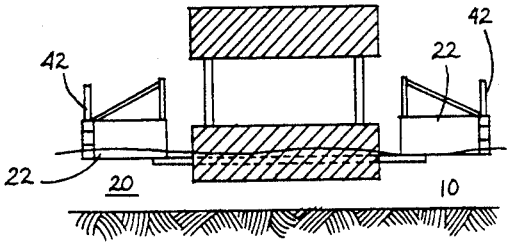
FIG. 9 is an end view of FIG. 8.
Figure 10:
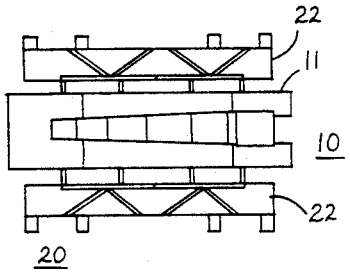
FIG. 10 is a plan view of the drilling barge located between the rigid parallel hulls of the apparatus.
Figure 11:
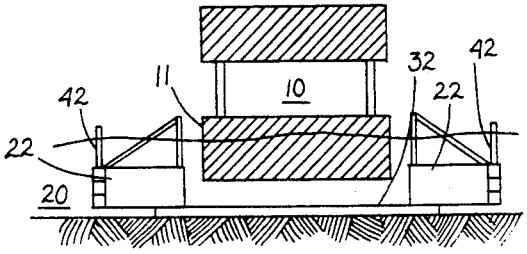
FIG. 11 is an end view of FIG. 10 showing the apparatus submerged.
Figure 12:
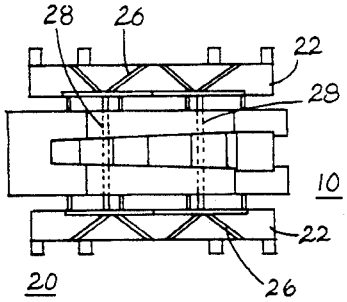
FIG. 12 is a plan view of the barge and apparatus in combination.
Figure 13:
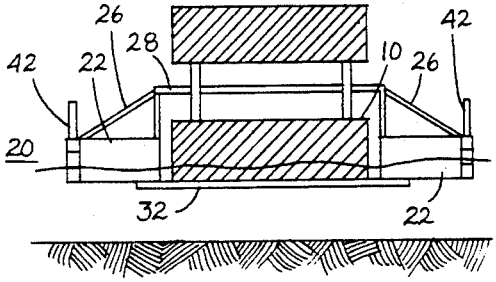
FIG. 13 is an end view of FIG. 12 showing the reduced draft of the drilling barge and apparatus in combination.
Figure 14:
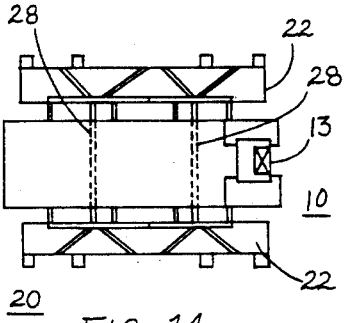
FIG. 14 is a plan view of the drilling barge and apparatus in combination with the drilling mast of the barge extended.
Figure 15:
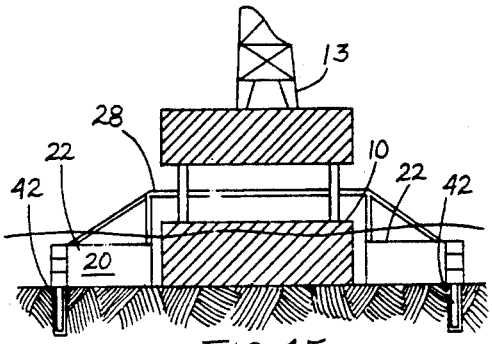
FIG. 15 is an end view of FIG. 14 showing the submerged drilling barge and apparatus on the water bottom.

FIGS. 8 through 15 illustrate the method of installing the apparatus and a drilling barge together in combination to reduce the draft and increase the loading bearing capacity of the barge. FIGS. 8 and 9 illustrate the apparatus and barge prior to installation of the apparatus. FIG. 8 is a plan view of the apparatus 20 and the drilling barge 10. The hull 11 of drilling barge 10 is shown centered between the parallel hulls 22 of the apparatus 20. FIG. 9 is an end elevation view of FIG. 8. The piling 42 are retracted. FIG. 10 shows the apparatus 20 after ballast has been added to the parallel hulls 20 to submerge the apparatus. The drilling barge 10 is shown after it has been floated into place between the parallel hulls 22 and over the connecting frame 32. The apparatus 20 is positioned along the hull 11 of barge 10 to level the trim of barge 11. FIG. 11 is an elevational view of FIG. 10 showing the submerged apparatus 20. The piling 42 retracted. FIG. 12 shows the apparatus and barge in combination after ballast has been removed from the hulls 22. The horizontal compression members 28 have been installed between the support frames 26. The additional hull volume reduces the draft of the apparatus 20 and barge 20 in combination. FIG. 13 is an elevational view of FIG. 12. The draft of the barge has been reduced by the installation of the apparatus. The piling 42 are retracted. The apparatus and barge can then be towed to the drilling site for installation. FIGS. 14 and 15 show the barge 10 and apparatus 20 in combination submerged on the water bottom at the drilling site. Ballast has been added to the hull 11 of the barge 10 and the hulls 22 of the apparatus 20 to submerge the apparatus 10 and barge 20 in combination to rest on the water bottom. The piling 42 are shown after they have been forced down into the water bottom soil by winching or other means. The drilling mast 13 of the barge 10 has been extended for drilling operations.

It is thought that the method and apparatus for reducing the draft and increasing the load bearing area and stability of a marine drilling barge and its attendant advantages will be understood from the foregoing description. It will be apparent that various changes may be made in the form, construction and arrangement of the parts thereof without departing from the spirit and scope of the invention or sacrificing all of its material advantages, the form and procedure hereinbefore described being merely a preferred or exemplary embodiment of the apparatus and method.

I claim:

1. An apparatus for reducing the draft and increasing the load bearing area and stability of a marine drilling barge, comprising:

(a) first and second rigid parallel hulls separated spacedly from each other a distance sufficient to accommodate the width of said drilling barge, each of said parallel hulls having a substantially rectangular cross-section with a substantially horizontal top and bottom and substantially vertical sides;

(b) a framework of horizontal tension resistant members, spanning between said parallel hulls at the bottom of said hulls, connecting said hulls together;

(c) a plurality of brackets connected to the longitudinal sides of said barge hulls so that said tops of said parallel hulls of said apparatus will rest against said brackets and hold the bottom of said parallel hulls in substantially the same plane as the bottom of said barge hull;

(d) means for transferring the compression loads between said rigid parallel hulls across the deck of said drilling barge; and (e) means for adding and removing ballast to and from said rigid parallel hulls.

2. An apparatus for reducing the draft and increasing the load bearing area and stability of a marine drilling barge as recited in claim 1, wherein said framework of horizontal tension resistant members is a truss.

3. An apparatus for reducing the draft and increasing the load bearing area and stability of a marine drilling barge as recited in claim 1, wherein said means for transferring the compression loads across the deck of said drilling barge between said hulls includes:

(a) A plurality of vertical support frames mounted on the decks of said rigid parallel hulls; and (b) a plurality of horizontal support beams spanning across the deck of said drilling barge connecting said vertical support frames on said first rigid hull to said vertical support frames on said second rigid hull.

4. An apparatus for reducing the draft and increasing the load bearing area and stability of a marine drilling barge as recited in claim 1, wherein said means for transferring the tension loads across the bottom of said drilling barge between said hulls is structural plate.

5. An apparatus as recited in claim 1 where said means for adding and removing ballast includes pumping water into and out of said rigid hulls.

6. An apparatus as recited in claim 1 further comprising a means for guiding a plurality of retractable piling attached to the external peripheral vertical sides of said rigid parallel hulls.

7. An apparatus for reducing the draft and increasing the bearing area and stability of a marine drilling barge comprising:

(a) first and second rigid and substantially parallel outrigger hulls having a substantially rectangular cross-section separated spacedly from each other a distance sufficient to accommodate the width of said drilling barge between said outrigger hulls;

(b) a plurality of horizontal tension resistant connecting members located substantially at the bottom of said outrigger hulls spanning between and separating spacedly said outrigger hulls from each other;

(c) a plurality of horizontal compression resistant connecting members spanning between and above the decks of said outrigger hulls;

(d) a first support frame mounted on the deck of said first outrigger hull and a second frame mounted on the deck of said second outrigger connected to each other by said horizontal compression resistant connecting members;

(e) a means for connecting said first and second outrigger hulls to said drilling barge so that bottom of each outrigger hull is in substantially the same plane as the bottom of said drilling barge; and (f) a means for submerging and emerging said outrigger hulls.

8. An apparatus for reducing the draft and increasing the load bearing area of a marine drilling barge as recited in claim 7 further comprising a plurality of guides connected to the periphery of said outrigger hulls for inserting retractable vertical anchor piling.

9. An apparatus for reducing and the draft and increasing the load bearing area and stability of a marine drilling barge as recited in claim 7 wherein said means for submerging and emerging said outrigger hulls includes pumping water into and out of said outrigger hulls.

10. An apparatus for reducing the draft and increasing the land area and stability of a marine drilling barge as recited in claim 7 further comprising a removable rib projecting from the bottom along the periphery of each said outrigger hull.

11. An apparatus as recited in claim 7 wherein said means for connecting said outrigger hulls to said drilling barge so that the bottom of each outrigger hull is in substantially the same plane as the bottom of said drilling barge is a plurality of L-shaped members connected to said outrigger hulls.

12. A method for reducing the draft and increasing the load bearing area and stability of a marine drilling barge supporting a drilling rig, work area and equipment comprising:

(a) providing a pair of parallel outrigger hulls connected together horizontally by a structural system at the base of each outrigger hull;

(b) pumping water into said outrigger hulls to submerge said outrigger hulls so that said horizontal hull connecting structural system at said base of said outrigger hulls is submerged below the bottom of said drilling barge;

(c) floating said drilling barge between said outrigger hulls;

(d) attaching said outrigger hulls to said drilling barge;

(e) installing a supporting framework between said outrigger hulls to transfer loads across the deck of said drilling barge;

(f) pumping the water from said outrigger hulls to increase the buoyancy of said outrigger hulls and thereby raising said outrigger hulls and said barge and thereby reducing the draft of said drilling barge;

(g) moving said apparatus and said barge to the desired location; and (h) pumping water into the hull of said barge and said parallel outrigger hulls so as to submerge said parallel hulls and said barge together as a unit to rest on the water bottom as a foundation for the drilling rig, work area and equipment.

* * * * *